US005421131A

United States Patent [19]

Heckman et al.

[11] Patent Number: 5,421,131

[45] Date of Patent: Jun. 6, 1995

[54] RAILING AND BENCH COMBINATION

[76] Inventors: Ronald E. Heckman; Mary E. Heckman, both of 821 S. Harlem Ave., Freeport, Ill. 61032

[21] Appl. No.: 174,516

[22] Filed: Dec. 28, 1993

[51] Int. Cl.[6] ..... E04B 1/00

[52] U.S. Cl. ..... 52/263; 256/67; 297/14

[58] Field of Search ..... 256/64, 65, 67; 52/173.1, 263, 27, 29; 108/47, 48; 312/313, 314, 235.4; 297/14

[56] References Cited

U.S. PATENT DOCUMENTS

| | | | |
|---|---|---|---|
| 1,870,719 | 8/1932 | Fain . | |
| 2,112,087 | 3/1938 | Golod et al. | 155/124 |
| 2,559,021 | 7/1951 | Leonard | 287/95 |
| 2,583,372 | 1/1952 | Hall | 155/83 |
| 4,009,903 | 3/1977 | Manspeaker | 297/14 |
| 4,823,529 | 4/1989 | Canfield et al. | 52/263 |
| 4,926,783 | 5/1990 | Lathers | 114/363 |

*Primary Examiner*—Carl D. Friedman
*Assistant Examiner*—Creighton Smith
*Attorney, Agent, or Firm*—David L. Baker; Rhodes & Ascolillo

[57] ABSTRACT

In a preferred embodiment, a railing and bench combination, integral to a deck or patio railing structure, the railing structure including an upper railing member, a lower railing member, and a plurality of vertical railing spokes attached to and disposed between the upper and lower railing members, the railing and bench combination including: a top railing member, disposed between sections of the upper railing member; a plurality of vertical support members, fixedly attached to the top railing member and extending to a deck floor and fixedly attached thereto, and disposed in parallel with the railing spokes; a generally vertical back rest fixedly attached to the support members; a bench structure, having distal and proximal edges, the proximal edge being pivotally attached by attachment apparatus to endmost of the support members for rotation between a first, vertical position with the bench structure comprising part of the railing structure, and a second, horizontal position with the bench structure in use as a bench; and support structure to support the bench structure above the deck floor when the bench structure is in the second, horizontal position.

7 Claims, 3 Drawing Sheets

RAILING AND BENCH COMBINATION

BACKGROUND OF THE INVENTION

1. Field of the Invention

The present invention relates to deck benches generally and, more particularly, but not by way of limitation, to a novel deck bench that also collapses and functions as part of a deck's railing.

2. Description of the Related Art

U.S. Pat. No. 1,870,719, issued Aug. 9, 1932, to Fain, describes a concealable indoor furnishing which includes a table and associated bench seats. The several associated pieces are capable of being collapsed and folded against a wall or other supporting surface, or in a cabinet when in disuse.

U.S. Pat. No. 2,112,087, issued Mar. 22, 1938, to Golod and Kantrowitz, describes a combination cabinet having a decorative fire place and dinette set therein.

U.S. Pat. No. 2,559,021, issued Jul. 3, 1951, to Leonard, describes a foldable dinette table and bench combination which can be installed as a unit within an attaching frame mounted on a wall.

U.S. Pat. No. 2,583,372, issued Jan. 22, 1952, to Hall, describes a built-in deck chair for use on a boat, which when not in use, is arranged in closed or folded condition in its own separate casing or cabinet, such cabinet secured to the side wall of the boat's deck house and capable of being locked.

U.S. Pat. No. 4,926,7883, issued May 22, 1990, to Lathers, describes a recreational boat seat/sun deck which when not in use, can be folded into a vertical position against a transom wall. When in use the boat seat is unfolded perpendicular to the transom wall. An additional folding member can be extended so as to form, in combination with the boat seat, a sun deck.

SUMMARY OF THE INVENTION

A railing and bench combination is a virtual necessity for a deck. It provides extra seating for outdoor parties as well as the convenience of the extra space that is made available when the bench is collapsed.

While the present invention is described with reference to its application as a railing and bench combination for a deck or patio, it will be apparent that it is applicable as well to other host structures such as trellises, wooden fences, and gazebos. None of the above devices is readily adaptable to provide the desired features set forth above.

Accordingly, it is a principal object of the present invention to provide a railing and bench combination for an outdoor deck or patio.

It is another object of the present invention to provide a bench which pivots into a horizontal position when in use as a bench and which pivots into a vertical position when collapsed to form part of a deck railing structure.

It is a further object of the present invention to provide bench support legs which pivot into vertical position when the bench is in use and which pivot into horizontal position when the bench is collapsed to form part of a deck railing structure.

Another object of the present invention is to permit relatively simple, economical construction of the invention by the user, utilizing commonly available construction materials.

Other objects of the present invention, as well as particular features, elements, and advantages thereof, will be elucidated in, or be apparent from, the following description and the accompanying drawing figures.

The present invention achieves the above objects, among others, by providing, in a preferred embodiment, a railing and bench combination integral to a deck or patio railing structure. The railing structure includes an upper railing member, a lower railing member, and a plurality of vertical railing spokes attached to and disposed between the upper and lower railing members. The railing and bench combination essentially consists of a top railing member which is disposed between sections of the upper railing member, a plurality of vertical support members which are attached to the top railing member and extend to a deck floor, a generally vertical back rest attached to the support members, and a bench structure, having distal and proximal edges, with the proximal edge being pivotally attached by an attachment mechanism to the endmost support members for rotation between a first vertical position and a second horizontal position. Additionally, there is provided a mechanism to support the bench structure above the deck floor when the bench structure is in the horizontal position.

Preferably, the attachment mechanism includes two seat pivot supports attached to an underside of the bench structure, forming endmost sides of the bench structure, and having proximal ends pivotally attached to the endmost support members by a shaft mechanism such that the seat pivot supports rotate within vertical planes parallel to the vertical planes in which the support members lie.

The mechanism to support the bench structure includes a plurality of bench support legs pivotally attached to an underside of the bench structure, near the distal edge, by a leg attachment mechanism, for rotation between a horizontal position when the railing and bench combination is functioning as a railing and a vertical position when the railing and bench combination is in use as a bench. There is also a mechanism to conceal the leg attachment mechanism which includes a plurality of hinges, with each of the hinges having two hinge leaves. One of the two hinge leaves is attached to the underside and the second of the two hinge leaves is attached to an end of one of the bench support legs such that first one of the bench support legs rotates under, and parallel to, the distal edge of the bench.

Preferably, the mechanism to conceal the attachment means includes a bench front trim piece attached to an underside surface of, and parallel with, the distal edge of said bench structure.

In yet another aspect, the invention generally features an adjustment mechanism for adjusting the height of the bench structure with respect to the deck floor. Preferably, this mechanism includes a vertical deck screw affixed to a bottom surface of the bench support leg.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
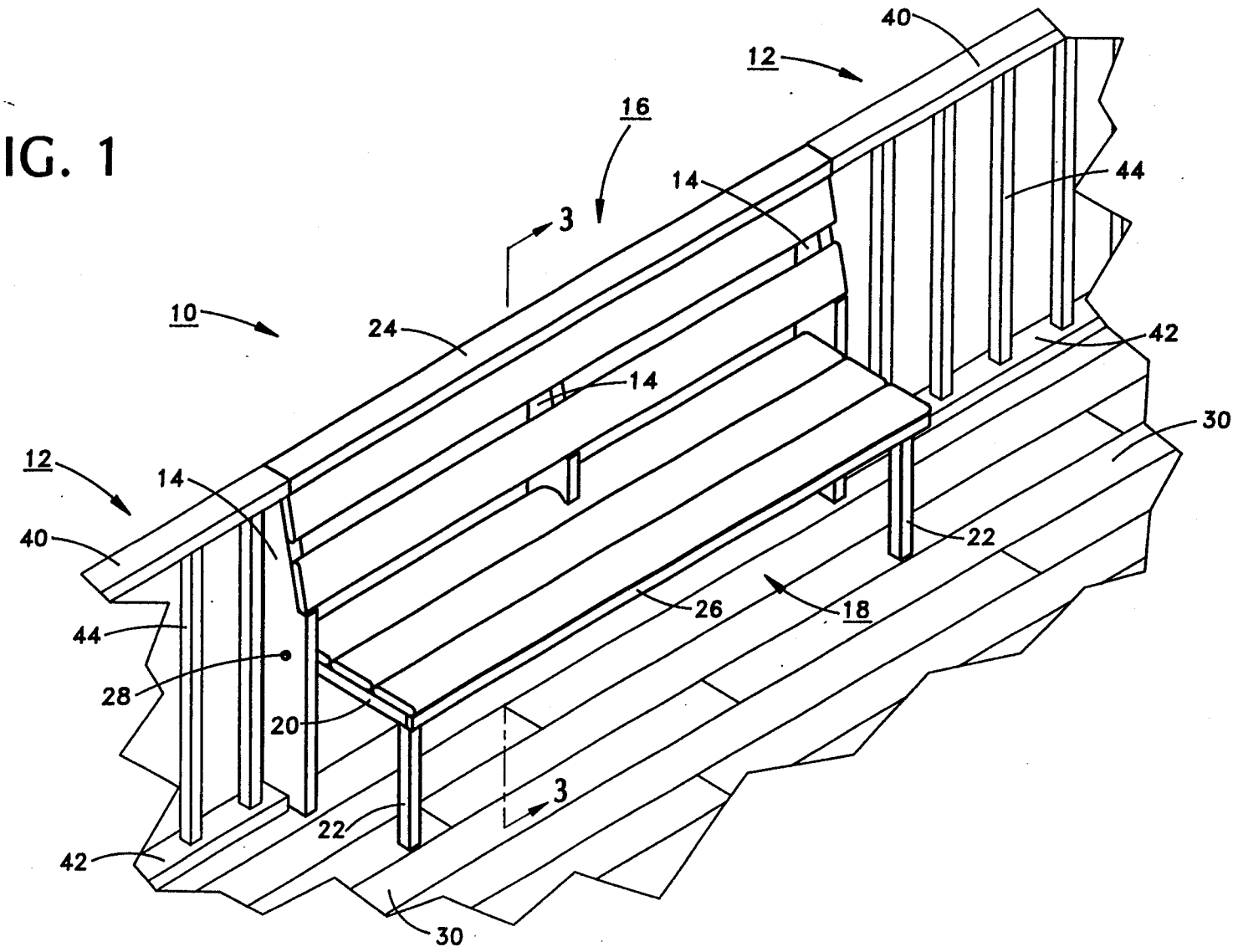
FIG. 1 is an isometric view illustrating a railing and bench combination, constructed according to the present invention, showing a bench and bench support legs pivoted into position when in use as a bench.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Reference should first be made to FIG. 1 which shows the railing and bench combination of the present invention, generally indicated by the reference numeral 10. The railing and bench combination 10 includes a back rest member, generally indicated by the reference numeral 16, and a bench member, generally indicated by the reference numeral 18. As shown on FIG. 1, bench member 18 is in a horizontal position for use as a bench, and back rest member 16 is fixed to and forms an integral part of a deck railing, generally indicated by the reference numeral 12. Deck railing 12 comprises a horizontal upper railing member 40, a horizontal lower railing member 42, and a plurality of railing spokes 44 vertically disposed between the upper railing member 40 and the lower railing member 42.

The railing and bench combination 10 includes a railing member 24, disposed between sections of upper railing member 40, and a plurality of support members 14, which extend vertically between railing member 40 and deck floorboards 30, with back rest 16 fixedly attached to the endmost support members 14. Bench member 18 includes two seat pivot supports 20 (only one visible on FIG. 1) forming the edges of the bench member and having the proximal ends thereof pivotally attached to endmost support members 14 by means of shafts 28. A bench front trim piece 26 extends horizontally along the underside of the distal edge of bench member 18.

Figure 2:
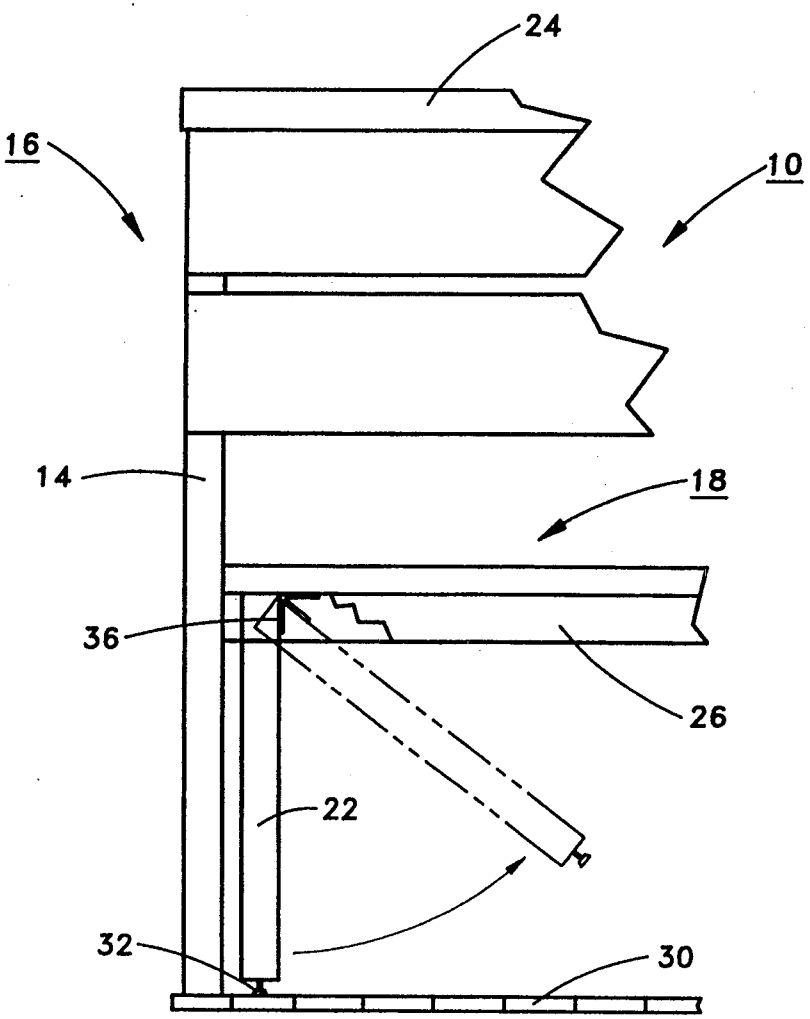
FIG. 2 is a fragmentary, front elevational view showing a bench support leg pivot motion between a vertical plane when in use to support a bench and a horizontal plane when not in use to support a bench.

Referring now to FIG. 2, a pair of bench support legs 22 (only one shown on FIG. 2) is pivotally attached to the underside of the bench member 18 near the distal edge thereof by means of hinges 36. FIG. 2 shows bench support leg 22 rotated pivotally with respect to bench member 18 from a stored position in horizontal juxtaposition adjacent the bottom of the bench member in parallel with the distal edge of the bench member and behind bench trim piece 26.

Figure 3:
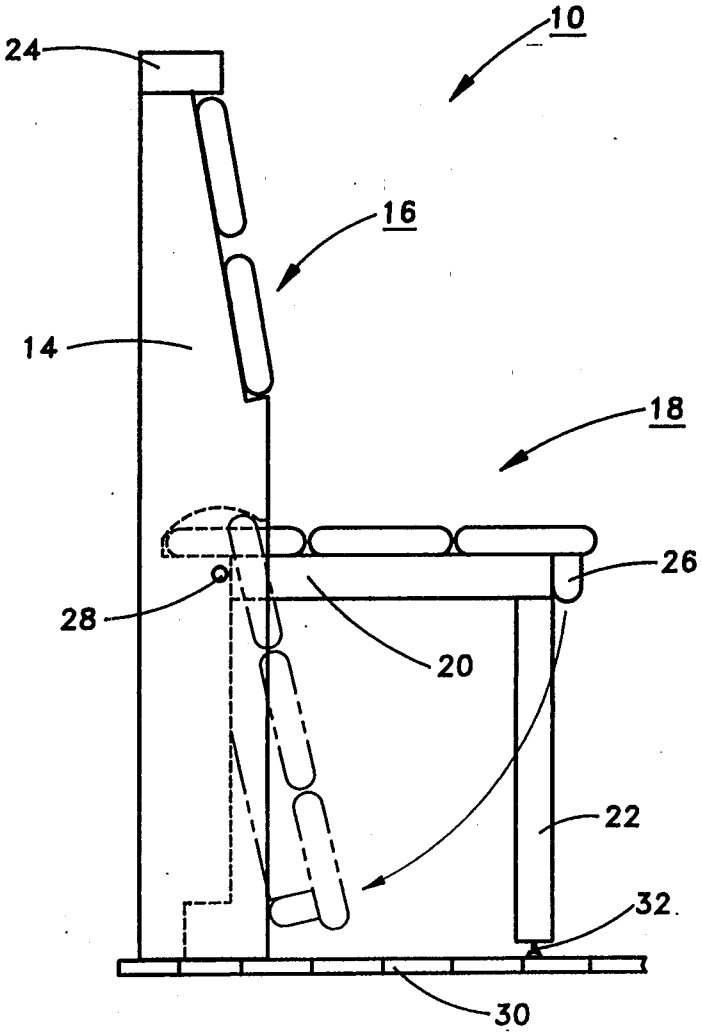
FIG. 3 is a side elevation view, in cross section, taken along reference line "3—3" of FIG. 1, showing the bench pivot motion between a horizontal plane when in use as a bench and a vertical plane when not in use as a bench and forming part of a railing structure.

As seen on FIG. 2 and 3, bench support leg 22 includes a deck screw 32, which is mounted on the bottom surface thereof in order to adjust the height of the bench member 18 with respect to the deck floorboards 30.

Reference should now be made to FIG. 3 which shows bench member 18 rotated pivotally with respect to support members 14 such that it will come to rest in vertical juxtaposition with support members 14.

Figure 4:
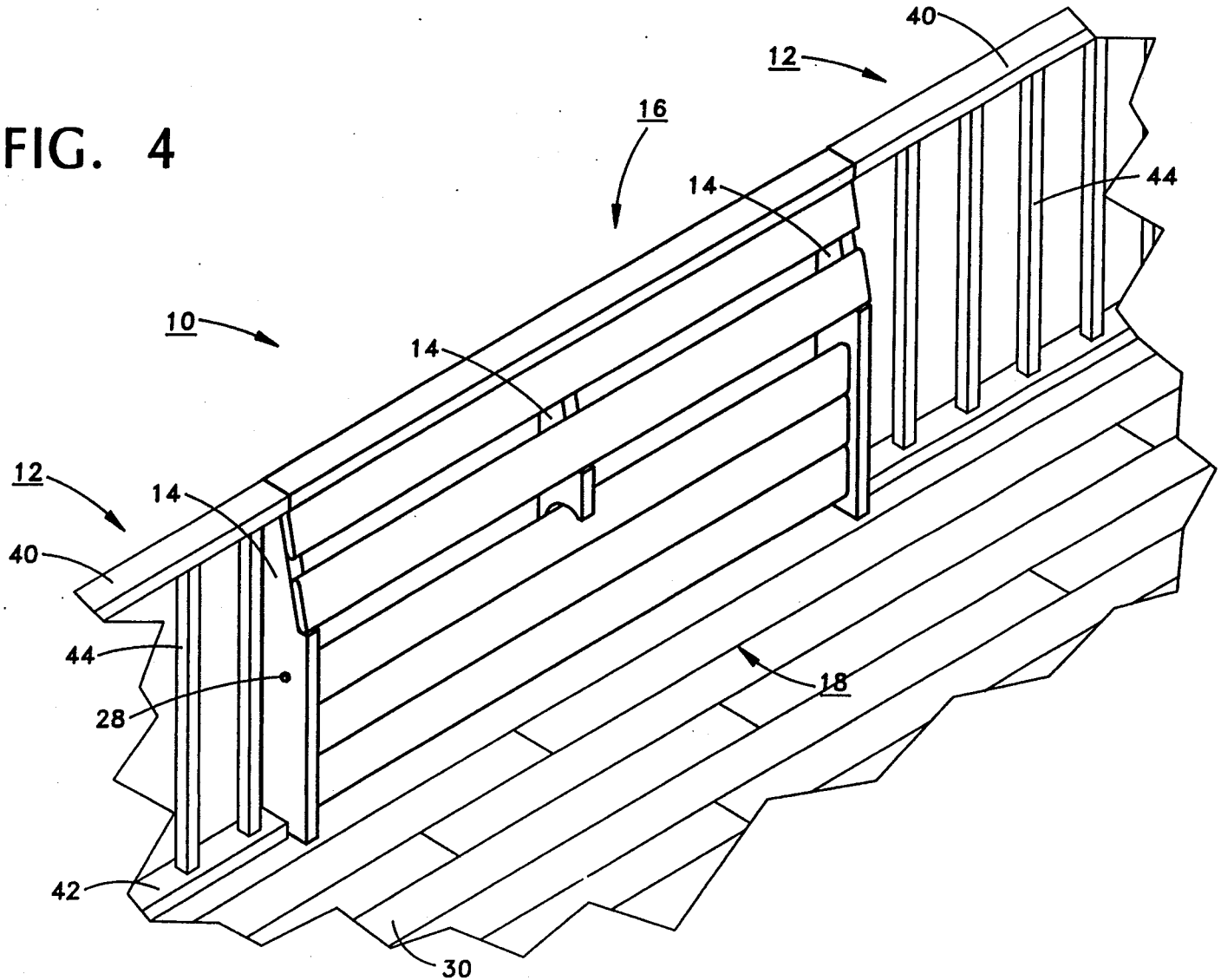
FIG. 4 is an isometric view showing a bench pivoted into a vertical position forming an integral part of a railing structure when not in use as a bench.

FIG. 4 shows railing and bench combination 10 fully collapsed and functioning as an integral part of deck railing 12.

In use, the railing and bench combination 10 is normally a part of deck railing 12 (FIG. 4) and, as such, consumes little more space than an equivalent section of the deck railing which it replaces. When it is desired to use the railing and bench combination 10 as a bench, bench member 18 is rotated from the vertical position shown on FIG. 4 to the horizontal position shown on FIG. 1. The support legs 22 are rotated to a vertical position (FIG. 2), and screws 32 are adjusted to raise the bench member 18 to the desired level. Reversing the foregoing procedure returns bench member 18 to the position shown on FIG. 4.

The railing and bench combination 10 may be economically constructed using commonly available lumber and hardware, and can be conveniently constructed as a unit and then installed to replace a removed section of an existing deck railing 12 (FIG. 4).

When constructed for use with other host structures such as a trellis, a wooden fence, or a gazebo, the railing and bench combination 10 serves also to provide a sitting bench to enjoy the beauty of a garden, a potting bench to prepare soil and flowers or shrubs for planting, a sitting bench along a fence providing opportunity for a brief rest while gardening, or in a gazebo where quiet conversation may be enjoyed with a friend. Once collapsed, the railing and bench combination 10 forms an integral part of the host structure maintaining privacy and security as well as generally continuing the architectural lines of the host structure.

The railing and bench combination 10 is intended to be provided as a set of plans. It nominally features 1¼-inch by 6-inch decking boards for back rest member 16 and bench member 18, although other size lumber may be used for customized appearances. The design of the railing and bench combination 10 is simple enough to permit do-it-yourself persons the satisfaction of constructing it themselves. In addition, the design allows for considerable flexibility in the actual construction; the railing and bench combination 10 can be built to any length desired.

Finally, the railing and bench combination 10 features endmost support members 14 as well as center support members 14 at three to four foot intervals which insures the stability of the structure. Furthermore, standard treated deck lumber can be used to provide years of enjoyable use by withstanding outdoor elements, and thus avoiding exotic materials that might otherwise make the cost of the project prohibitive.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A railing and bench combination, integral to a deck or patio railing structure, said railing structure including an upper railing member, a lower railing member, and a plurality of vertical railing spokes attached to and disposed between said upper and lower railing members, said railing and bench combination comprising:

(a) a top railing member, disposed between sections of said upper railing member;

(b) a plurality of vertical support members, fixedly attached to said top railing member and extending to a deck floor and fixedly attached thereto, and disposed in parallel with said railing spokes;

(c) a generally vertical back rest fixedly attached to said support members;

(d) a bench structure, having distal and proximal edges, said proximal edge being pivotally attached by attachment means to endmost said support members for rotation between a first, vertical position with said bench structure comprising part of said railing structure, and a second, horizontal position with said bench structure in use as a bench; and (e) means to support said bench structure above said deck floor when said bench structure is in said second, horizontal position.

2. A railing and bench combination, as defined in claim 1, wherein said attachment means comprises two seat pivot supports fixedly attached to an underside of said bench structure, forming endmost sides of said bench structure, and having proximal ends pivotally attached to endmost said support members by shaft means such that said seat pivot supports rotate within vertical planes parallel to vertical planes in which said support members lie.

3. A railing and bench combination, as defined in claim 1, wherein said means to support said bench structure comprises:

(a) a plurality of bench support legs pivotally attached to an underside of said bench structure, near said distal edge, by leg attachment means, for rotation between a first, horizontal position when said railing and bench combination is functioning as a railing and a second, vertical position when said railing and bench combination is in use as a bench; and (b) means to conceal said leg attachment means.

4. A railing and bench combination, as defined in claim 3, wherein said leg attachment means comprises a plurality of hinges, each of said hinges having two hinge leaves, wherein one of said two hinge leaves is attached to said underside and a second of said two hinge leaves is attached to an end of one of said bench support legs such that said one of said bench support legs rotates under and parallel to said distal edge of said bench.

5. A railing and bench combination, as defined in claim 3, wherein said means to conceal said attachment means comprises a bench front trim piece attached to an underside surface of, and parallel with, said distal edge of said bench structure.

6. A railing and bench combination, integral to a deck or patio railing structure, said railing structure including an upper railing member, a lower railing member, and a plurality of vertical railing spokes attached to and disposed between said upper and lower railing members, said railing and bench combination comprising:

(a) a top railing member, disposed between sections of said upper railing member;

(b) a plurality of vertical support members, fixedly attached to said top railing member and extending to a deck floor and fixedly attached thereto, and disposed in parallel with said railing spokes;

(c) a generally vertical back rest fixedly attached to said support members;

(d) a bench structure, having distal and proximal edges, said proximal edge being pivotally attached to endmost said support members by two seat pivot supports fixedly attached to an underside of said bench structure, forming endmost sides of said bench structure, and having proximal ends pivotally attached to endmost said support members by shaft means such that said seat pivot supports rotate within vertical planes parallel to vertical planes in which said support members lie;

(e) a plurality of bench support legs pivotally attached to an underside of said bench structure, near said distal edge, by a plurality of hinges, each of said hinges having two hinge leaves, wherein one of said two hinge leaves is attached to said underside and a second of said two hinge leaves is attached to an end of one of said bench support legs such that said one of said bench support legs rotates under and parallel to said distal edge of said bench;

(f) a bench front trim piece attached to an underside surface of, and parallel with, said distal edge of said bench structure; and (g) adjustment means for adjusting the height of said bench structure with respect to said deck floor.

7. A railing and bench combination, as defined in claim 6, wherein said adjustment means comprises a vertical deck screw affixed to a bottom surface of said bench support leg.

* * * * *